US005325078A

United States Patent [19]

Carothers

[11] Patent Number: 5,325,078

[45] Date of Patent: Jun. 28, 1994

[54] GRAVITY ACTUATED MAGNETIC SWITCH

[75] Inventor: Kenneth E. Carothers, Howell, Mich.

[73] Assignee: May & Scofield, Inc., Howell, Mich.

[21] Appl. No.: 967,656

[22] Filed: Oct. 28, 1992

[51] Int. Cl.[5] ..... H01H 9/00

[52] U.S. Cl. ..... 335/205; 335/206

[58] Field of Search ..... 335/205-207; 200/52 A

[56] References Cited

U.S. PATENT DOCUMENTS

| | | | |
|---|---|---|---|
| 4,313,111 | 1/1982 | Anderson | 340/611 |
| 4,864,288 | 9/1989 | Anderson | 340/669 |
| 5,079,943 | 1/1992 | Custer | 73/3 |
| 5,086,273 | 2/1992 | Leon | 324/207.1 |

*Primary Examiner*—Lincoln Donovan

*Attorney, Agent, or Firm*—Harness, Dickey & Pierce

[57] ABSTRACT

A switch assembly which is switchable between on and off positions in response to the tilting of the assembly. The switch assembly includes a magnet which is retained within a housing for gravitational movement during tilting of the assembly. The magnet is movable between a distal position, in which it is spaced apart from a magnetic switch, and a position adjacent to the switch. The proximity of the magnet to the switch causes the switch to be either electrically open or closed.

5 Claims, 3 Drawing Sheets

GRAVITY ACTUATED MAGNETIC SWITCH

BACKGROUND AND SUMMARY OF THE INVENTION

Generally, the present invention relates to a switch. More particularly, the invention relates to a gravity actuated magnetic switch as might use in an illumination assembly under the hood of a motor vehicle.

In order to increase visibility during low light conditions, illumination assemblies have long been provided within the engine and trunk compartments of motor vehicles. For various reasons, including maximum illumination, these illumination assemblies are typically located on the under side or interior surface of the hood and trunk lid. The desire to increase operator convenience has resulted in the standard industry practice of providing these illumination assemblies so that they are automatically actuated by the raising and lowering of the hood or trunk lid itself.

Various mechanisms are presently used by the motor vehicle manufacturers to switch the illumination assemblies on and off. One variety of switching mechanism which has been widely used in the above and other applications is the plunger switch Depending on the particular application, in this variety a plunger is released (or depressed) during the raising (or lowering) of the hood to close (or open) electrical contacts within the switch and illuminate (or turn off) the assembly.

One limitation associated with plunger switches is the need for positioning the switch where the plunger will be actuated by relative movement between two different structures of the vehicle, such as the hood and the interior frame of the engine compartment. Another limitation is the number of mechanical components needed in the switch and their corresponding potential for wear and failure.

Another variety of switch which has been extensively used to turn on and off the illumination assemblies associated with the engine and trunk compartments of a motor vehicles is the mercury switch. These switches contain a capsule in which two electrical contacts are physically spaced apart. The capsule is also partially filled with the liquid metal mercury. Upon the raising of the hood or trunk lid, the mercury flows into a position where it contacts both of the electrical terminals, establishes a conductive path between them, and energizes the illumination assembly.

Mercury switches, however, are not without their own limitations. With a continuing increase in the public's environmental awareness, the use of switches containing the highly toxic mercury has fallen and will probably continue to fall into disfavor.

From the above, it can be seen that there is a need and desire for a switch which is environmental friendly, simple in construction and not susceptible to significant wear problems of its associated hardware.

With the above limitations in mind, it is an object of the present invention to provide a switch assembly which is actuated in response to movement of the structure to which it is mounted.

Another object of this invention is to provide a switch assembly for use in an illumination system associated with a motor vehicle's engine and/or trunk compartments.

A further object of this invention is to provide an illumination system having a switch assembly which is actuated under the influence of gravity during the opening and closing of the vehicle hood and/or trunk lid.

Still another object of the present invention is to provide a switch assembly which is simple in construction and cost efficient to produce.

Another object of this invention is to provide a switch assembly which is environmentally friendly.

A further object of this invention is to provide an illumination system having a switch assembly which minimizes the use of mechanical components that are susceptible to wear and failure.

With the above and other objects in mind, the present invention broadly provides for a switch assembly which is actuated under the influence of gravity to turn on or off an illumination system a might be used in conjunction with the engine and trunk compartments of a motor vehicle. The switch assembly is therefore switchable between on and off positions solely in response to the raising and lowering of the hood or trunk lid. More particularly, it is the tilting of the switch assembly itself which causes the assembly to turn on and off.

In the switch assembly of the present invention, a magnet is retained within a housing in a manner which permits it to move between an "on" position and an "off" position as the assembly is tilted. When moved into its "on" position, the magnet is located adjacent to a switch or sensor which is induced, because of the magnet's proximity, to electrically close. When the hood or trunk lid is closed and the magnet is located in its "off" position, away from the switch or sensor, the assembly will be electrically open or closed thus operating the illumination system.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE PREFERRED EMBODIMENT

Figure 1:
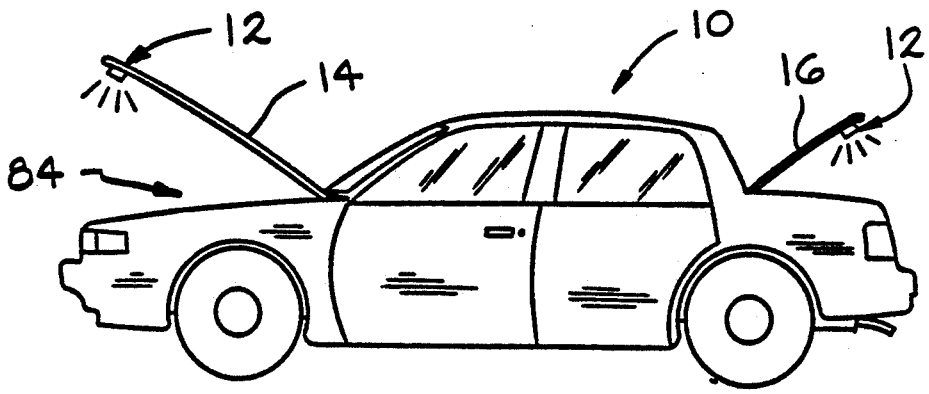
FIG. 1 is a side elevational view of a motor vehicle illustrating the mounting of the present invention to the hood and trunk lid thereof.

Referring now to the drawing, a motor vehicle incorporating the present invention is illustrated in FIG. 1 and generally designated at 1. FIG. 1 also shows two illumination assemblies 12 embodying the principles of the present invention in their "on" positions and being respectively mounted to an opened hood 14 and trunk lid 16 of the vehicle 10. As will become apparent from the following discussion, when the hood 14 and trunk lid 16 are closed, the illumination assemblies 12 will automatically turn off and prevent any undue drain on the battery of the vehicle 10.

While the present invention is specifically described with reference to the hood 14 and trunk lid 16 of the vehicle 10, it will be appreciated that the present invention will have utility in numerous other applications where it is desirable to have an illumination assembly turn on in response to movement of some body (e.g. the door of a glove box, a visor assembly, the opening of a garage door, etc.).

The illumination assembly 12 of the present invention includes a housing 18 to which is attached a transparent cover 20. The cover 20 may be secured by conventional methods such as ramped shoulders 22 formed on resilient tabs 23 of the cover 20 and engaging notches 24 defined in the housing 18. The cover 20 itself may be partially or completely transparent or translucent and may additionally have a light diffusing pattern formed therein.

The housing 18 is generally rectangular in shape and includes four upright side walls 26. Extending outward from two of the opposing side walls 26 of the housing 18 are a pair of mounting flanges 28 having apertures 30 defined therethrough. A screw, bolt or other type of fastener (not shown) is inserted through the aperture 30 of the mounting flange 28 in order to secure the illumination assembly 12 to the vehicle hood 14.

At approximately mid-height of the housing 18, a concave web or tub 32 extends between the opposing side walls 26. The concave surface of the tub 32 may exhibit a light reflecting color and the tub 32 itself, along with the remainder of the housing 18, is preferably formed out of a heat resistant material.

Figure 7:
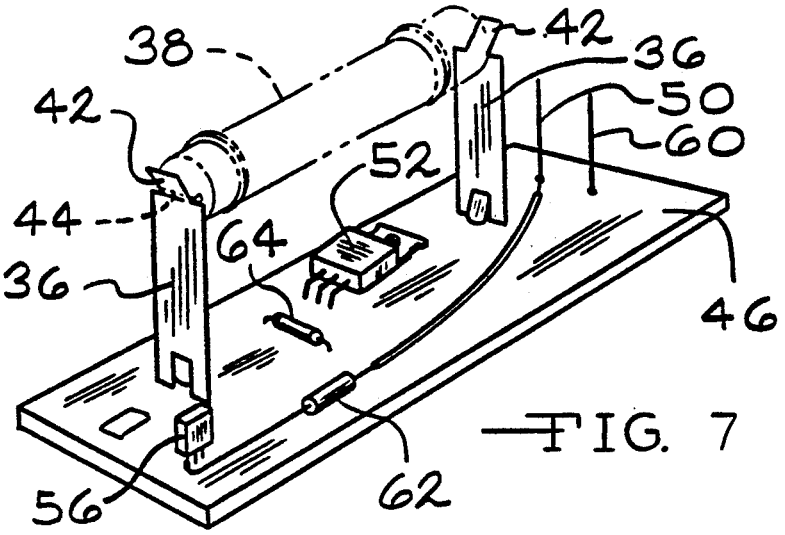
FIG. 7 is a perspective view illustrating the various electrical components used in the present invention.

Two slots 34 are defined in the tub 32 and tabbed electrical terminals 36 are received through the slots 34. The terminals 36 are used to mount a lamp 38 within the housing 18 at a position spaced apart from the tub 32. The terminals 36 also electrically connect the lamp 38 to an electrical power source 40, such as the battery of the vehicle 10. To assist in mounting the lamp 38 to the terminals 36, the upper ends of the terminals 36 are provided with tabs 42 having a reduced thickness which permits a wire hook 44 of the lamp 38 to be received thereover. The tabs 42 are also bent or biased somewhat away from the lamp 38, as seen in FIG. 7, to prevent inadvertent removal of the lamp 38 from the terminals 36.

Terminals 36 are supported on a printed circuit board 46 along with additional components of the electrical circuit 48 used with the present invention. The electrical circuit 48 and the additional components are generally illustrated in FIGS. 2 and 7.

Figure 2:
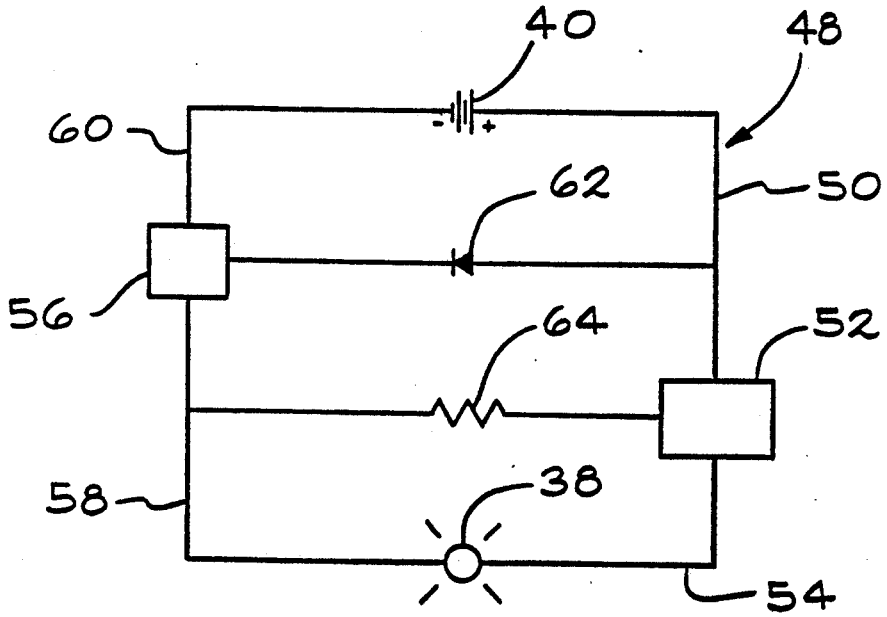
FIG. 2 is a schematic diagram of the circuit utilized by the present invention.
Figure 3:
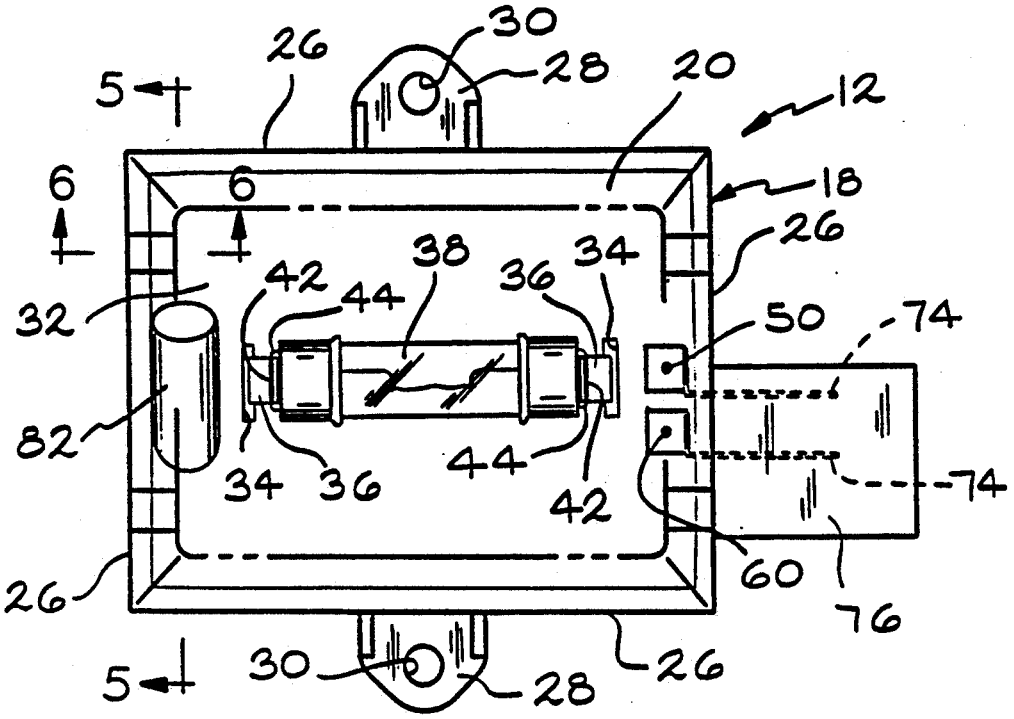
FIG. 3 is a plan view of an illumination assembly embodying the principles of the present invention.
Figure 4:
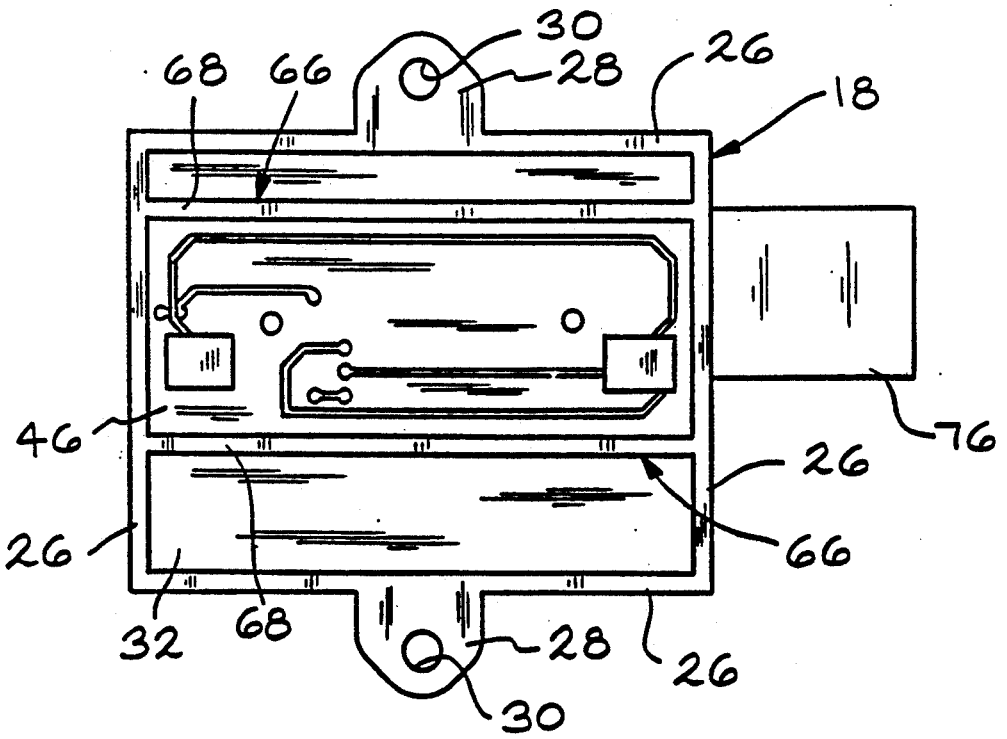
FIG. 4 is a bottom view of the illumination assembly illustrated in FIG. 3 showing the printed circuit board used therewith.

Referring now to FIG. 2 and the electrical circuit 48, line 50 connects the power source 40 to a transistor 52. The lamp 38 is connected to the transistor by line 54 and is also connected to a magnetic switch 56 by line 58. The magnetic switch 56 is further connected to the power source by line 60. Line 50 is connected to the magnetic switch 56 through a diode 62 while the transistor 52 is connected through a resistor 64 to line 58.

The printed circuit board 46 is mounted and secured in a portion of the housing 18, herein referred to as a frame 66, which is defined by two longitudinally extending walls 68 positioned between two of the opposing side walls 26. The width of the longitudinal walls 68 and the frame 66 are such that they contact the convex surface of the tub 32 and provide additional structural support thereto. Longitudinal walls 68 of the frame 66 are provided with stepped regions 70 upon which the printed circuit board 46 is supported and to which it may be secured by adhesive.

Conducting lines 50 and 60 extend through two apertures 72 defined in the tub 32 and make electrical contact with two plug terminals 74. The plug terminals 74 extend from within the housing 18 to a position outside of the housing 18 where they are received within a protective receptacle 76. In the illustrated embodiment, the receptacle 76 is an extension of one side wall 26 of the housing 18.

The receptacle 76 is configured to receive a male connector (not shown) within it so as to establish electrical contact between the plug terminals 74 and the power source 40 of the illumination assembly 12. By providing the illumination assembly 12 with the plug-in type receptacle 76, the assembly 12 lends itself to easy installation beneath the surface of the hood 14 and incorporation into the electrical system of the vehicle 10. This additionally allows the illumination assembly 12 to be easily replaced in the event of a malfunction.

As mentioned previously, the illumination assembly 12 of the present invention is in an "off" or unenergized position when the hood 14 is closed. To operate the magnetic switch 56, the illumination assembly includes a permanent magnet 78.

Figure 5A:
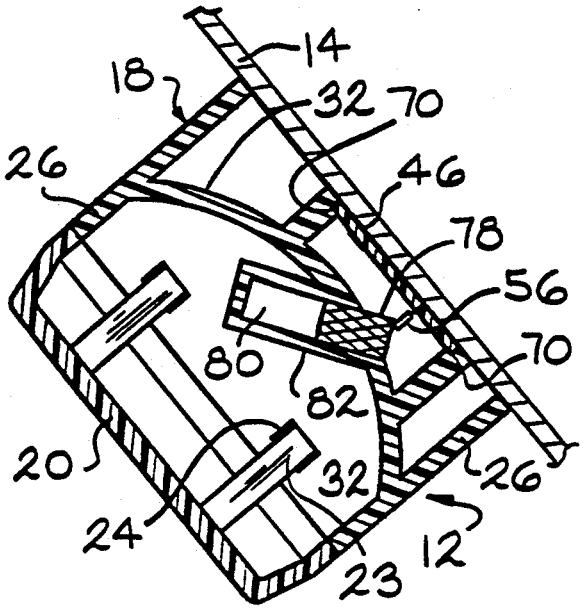
FIG. 5A is a sectional view taken substantially along line 5—5 in FIG. 3 showing the present invention titled into its "on" position.
Figure 5B:
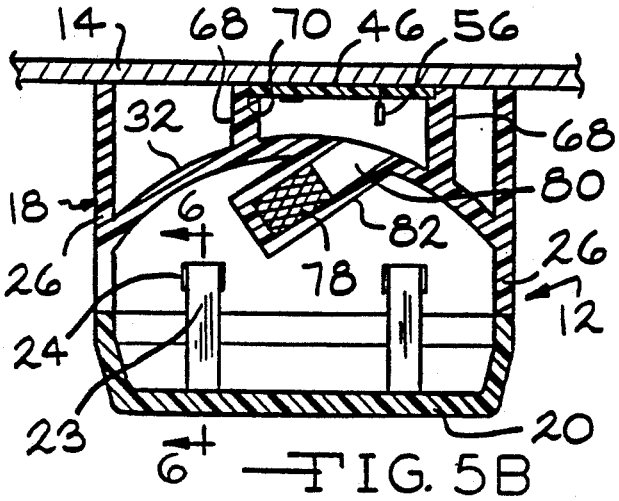
FIG. 5B is a sectional view, similar to that in FIG. 5A, showing the present invention tilted in its "off" position.
Figure 6:
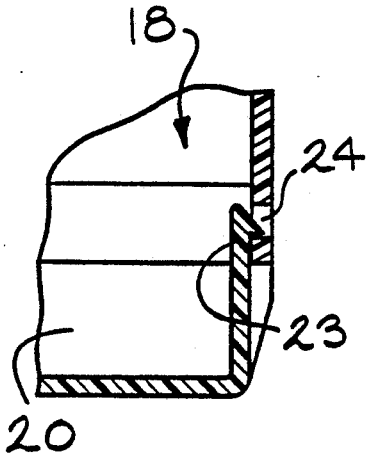
FIG. 6 is a sectional view taken substantially along line 6—6 in FIG. 5B showing the structure for used in mounting the cover to the housing of the present invention.

The magnet 78 is received within a passageway 80 defined by a cylindrical portion 82 of the tub 32. The cylindrical portion 82 and passageway 80 are angularly oriented with respect to the housing 18, or horizontal, so that the magnet 72 moves in a distal position away from the magnetic switch 56 when the hood 14 is closed. The magnet is shown in its distal position in FIG. 5B. When the hood 14 is partially or fully opened, as illustrated in FIG. 5A, the magnet 72 slides within the passageway 80 under the influence of gravitational forces into a position located adjacent to the magnetic switch 56. With the magnet 78 positioned adjacent to the magnetic switch 56, the switch 56 is caused to electrically close, energize the lamp 38, and illuminate the engine compartment 84 of the vehicle 10.

The magnetic switch 56 can be one of a variety of devices so long as the switch 56 electrically opens and closes in response to the proximity of a magnet 78 thereto. Such devices which can be used as a magnetic switch 56 include a Hall effect sensor, reed switch or other magnetically activated sensors or switches.

To turn off the illumination assembly 12, the hood 14 is closed. In response to the closing of the hood 14, the magnet 74 will move within the passageway 80, under the influence of gravitational forces, into its distal position away from the magnetic switch 56 allowing the switch 56 to return to its open electrical condition.

While the above description constitutes the preferred embodiments of the present invention, it will be appreciated that the invention is susceptible to modification, variation and change without departing from the proper scope and fair meaning of the accompanying claims.

What is claimed is:

1. An illumination assembly for mounting to a hood, trunk lid, visor, glove box door, garage door or other movable structure, said assembly to be connected to a power source and being switchable between on and off positions by changing the orientation of said entire assembly during movement of the movable structure, said assembly comprising:

a housing having a heat resistant generally concave tub extending between upright side walls;

a removable cover mounted to said housing, at least a portion of said cover being translucent and permitting light to be transmitted therethrough, said cover cooperating with said tub and said side walls to define a cavity;

a lamp;

mounting means for mounting said lamp within said cavity at a spaced apart location between said tub and said cover to allow light energy to be transmitter through said translucent portion of said cover;

a pair of electrically conductive lamp terminals, said terminals electrically connecting said lamp to the power source;

a magnet;

a magnetically actuated switch coupled between the power source and said lamp, said switch being electrically opened and closed in response to the proximity of said magnet thereto;

a passageway integrally formed in said tub, extending therefrom and dimensioned to receive said magnet therein, said passageway being angularly oriented between a horizontal axis and a vertical axis, said switch being located outside of said passageway, said passageway having a proximal end located adjacent to said switch and a distal end positioned away from said switch;

said magnet being received within said passageway for gravitational movement from said distal end to said proximal end and visa versa during a change in orientation of said entire assembly in response to movement of the movable structure, the positioning of said magnet in one of said ends electrically closing said switch and turning on said illumination assembly, the positioning of said magnet in the other of said ends electrically opening said switch and turning off said assembly; and means for mounting said assembly to the movable structure.

2. An illumination assembly as set forth in claim 1 wherein said passageway is angularly oriented such that said proximal end is positioned above said distal end when said illumination assembly is turned off, said passageway being angularly oriented such that said distal end is positioned above said proximal end when said illumination assembly is turned on.

3. An illumination assembly as set forth in claim 1 wherein said switch is electrically open when said magnet is in said distal position and is electrically closed when said magnet is in said proximal position.

4. An illumination assembly as set forth in claim 1 wherein said switch is a Hall effect sensor.

5. An illumination assembly as set forth in claim 1 wherein said switch is electrically open when said magnet is in said distal position and is electrically closed when said magnet is in said proximal position.

* * * * *

UNITED STATES PATENT AND TRADEMARK OFFICE

CERTIFICATE OF CORRECTION

PATENT NO. : 5,325,078

DATED : June 28, 1994

INVENTOR(S) : Kenneth E. Carothers

It is certified that error appears in the above-indentified patent and that said Letters Patent is hereby corrected as shown below:

In Column 2, line 15, after "system" delete "a" and insert —as—.

In Column 3, line 1, after "designated at" delete "1" and insert —10—.

In Column 5, Claim 1, lines 18 and 19, delete "transmitter" and insert —transmitted—.

Signed and Sealed this

Tenth Day of January, 1995

Bruce Lehman

*Attest:*

BRUCE LEHMAN

*Attesting Officer*

*Commissioner of Patents and Trademarks*